United States Patent [19]

Nakai

[11] 4,207,496

[45] Jun. 10, 1980

[54] MICROWAVE OUTPUT SECTION OF AN INTERNAL MAGNET TYPE MAGNETRON

[75] Inventor: Kaichiro Nakai, Yokohama, Japan

[73] Assignee: Tokyo Shibaura Denki Kabushiki Kaisha, Kawasaki, Japan

[21] Appl. No.: 944,550

[22] Filed: Sep. 21, 1978

[30] Foreign Application Priority Data

Sep. 27, 1977 [JP] Japan ..... 52-129755[U]

[51] Int. Cl.[2] ..... H01J 25/50

[52] U.S. Cl. ..... 315/39.53; 315/39.51; 315/39.71

[58] Field of Search ..... 315/39.51, 39.53, 39.71, 315/39.75

[56] References Cited

U.S. PATENT DOCUMENTS

| | | | |
|---|---|---|---|
| 3,849,737 | 11/1974 | Oguro | 315/39.53 |
| 4,006,382 | 2/1977 | Butler et al. | 315/39.53 |
| 4,048,542 | 9/1977 | Miura | 315/39.71 |
| 4,060,750 | 11/1977 | Tashiro et al. | 315/39.53 |
| 4,075,534 | 2/1978 | Saito et al. | 315/39.71 |
| 4,129,834 | 12/1978 | Kerstens | 315/39.53 |
| 4,131,824 | 12/1978 | Nakai et al. | 315/39.53 |

*Primary Examiner*—Saxfield Chatmon, Jr.
*Attorney, Agent, or Firm*—Cushman, Darby & Cushman

[57] ABSTRACT

An internal magnet type magnetron is provided with a pair of permanent magnets which are disposed facing each other in a cylindrical envelope. In a space between the permanent magnets, a cathode is disposed around which a number of vanes extend radially. An output conductor is connected to one of the vanes and is extended through a space around one of the permanent magnets to an output section attached to the envelope. Most of the output conductor part passing through the space around one of the permanent magnets is enclosed by an outer metal tube. An inner tube having a length as large as ¼ of harmonic wave λn is disposed in the outer metal tube. The inner and outer tubes are both electrically connected to the envelope.

7 Claims, 5 Drawing Figures

MICROWAVE OUTPUT SECTION OF AN INTERNAL MAGNET TYPE MAGNETRON

BACKGROUND OF THE INVENTION

The invention relates to an improvement of the so-called internal magnet type magnetron in which permanent magnets are disposed in an evacuated envelope hermetically sealed and, more particularly, to an improvement of the microwave output section of that type magnetron.

The internal magnet type magnetron has a good efficiency with respect to magnetic energy, compared with outer magnet type magnetrons in which the permanent magnets are disposed outside the evacuated envelope, in which magnetic energy may effectively be introduced from the magnets to an interaction space of the magnetron. The internal magnet type magnetron also have other advantages: is compact, the structure is simple and the cost is low. Although having such advantages, internal magnet type magnetrons have some problems at the experimental stage. One of them is that it is impossible to effectively transfer high frequency energy generated in a space defined by vanes and the cathode in an anode cylinder an output section, i.e., the output antenna. A possible cause of the problem is that the output antenna is weakly coupled with a vane in the oscillating reagion. Measurements show that only 30% of the generated high frequency energy is transmitted to the output section. Another problem is that electromagnetic energy of undesired modes is generated in the space around the permanent magnet and is transferred to the antenna, in addition to the predetermined electromagnetic energy. This arises from the structure of the internal magnet type magnetron, specifically that the output conductor extending from the vane to the antenna passes through an electromagnetic field having undesired modes in the space around the permanent magnet in the anode cylinder.

SUMMARY OF THE INVENTION

Accordingly, an object of the invention is to provide an internal magnet type magnetron with an output section into which predetermined electromagnetic energy may effectively be transferred without undesired electromagnetic energy anodes.

To achieve the object of the invention, there is provided a magnetron comprising: anode means including an anode cylinder and vanes each projecting from the inner wall of the anode cylinder toward the axis of the anode cylinder to define resonance cavities; a cathode disposed coaxial with the axis of the anode cylinder; a pair of permanent magnets which are oppositely disposed and applies a magnetic field to a space between the anode and cathode; sealing means for hermetically sealing a space in which a pair of the permanent magnets, vanes and cathode are disposed; a microwave output section mounted to the sealing means; an output conductor which is connected at one end to one of the vanes and at the other end to the output section, passing through a space between one of the permanent magnet and the sealing means; and a metal tube which encloses the output conductor, connected to the anode cylinder and having a length equal to approximately 70% or more of that of the output conductor part from the vane to the bottom of the anode cylinder.

Other objects and features of the invention will be apparent from the following description in conjunction with the accompanying drawings, in which:

DETAILED DESCRIPTION OF THE PREFERRED EMBODIMENTS

Figure 1:
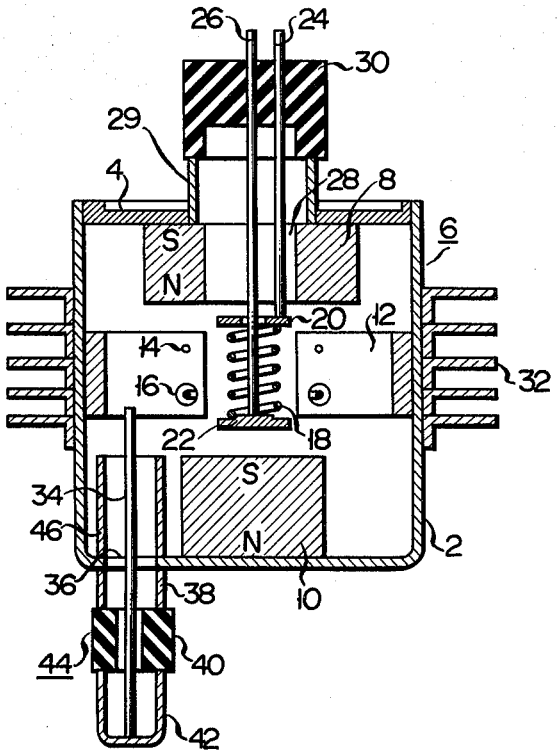
FIG. 1 shows a longitudinal sectional view of the internal magnet type magnetron of the one embodiment of the invention.

Referring now to FIG. 1, there is shown one embodiment of an internal magnet type magnetron according to the invention. As shown, a pair of permanent magnets 8 and 10, for example alnico magnets, are disposed in vacuum envelope 6 including anode cylinder 2 and metal cap 4 for hermetically sealing anode cylinder 2. Anode cylinder 2, which serves as a magnetic circuit of magnets 8 and 10, is made of a good electrical conducting material and a ferromagnetic material. Anode cylinder 2 is provided at the middle inner surface with a number of vanes 12 which are fixed thereonto and extended radially and inwardly to the center of anode cylinder 2. These vanes 12 and anode cylinder 2 are electrically connected to each other. A pair of straps 14 and 16 are provided as shown, with one strap connected to the alternate vanes and the other strap connected to the intervening vanes. Coil-shaped cathode 18, which is disposed coaxially with anode cylinder 2, is supported at the top by upper end hat 20 and at the bottom by lower end hat 22. End hats 20 and 22 are coupled with supporting rods 24 and 26, respectively. These supporting rods 24 and 26 pass through hole 28 formed in permanent magnet 8 and cover 30 which is made of an insulating material and mounted to metal cap 4 to outwardly extend to through seal ring 29. Anode cylinder 2 is provided at its outer surface with cooling fins 32 for radiating heat generated in an interaction space, where a magnetic field developed by magnets 8 and 10 and an electric field in the space defined by vanes 12 and cathode 18 interact with each other.

To direct microwave produced in the interaction space to the exterior, one end of an output conductor 34 is connected to the one of vanes 12 and the other end of output conductor 34 is extended through the bottom of anode cylinder 2. Hole 36, permitting the output conductor 34 to pass through cylinder 2, is formed at the bottom thereof. Output section 44 including metal antenna tube 38, ceramic tube 40 and metal hermetically coupled together, is mounted to the bottom of anode cylinder 2 so as to cover hole 36. The other end of output conductor 34 extending through hole 36 passes through a output section 44 to connect to a metal cap 42, with the result that a mono-pole antenna is formed.

Metal tube 46 is provided projecting upwardly from the bottom of anode cylinder 2, enclosing a part of output conductor 34 extending within anode cylinder 2. The length of metal tube 46 is selected to be more than approximately 70% of the thickness of permanent magnet 10, that is, the distance from the bottom of anode cylinder 2 to the top surface of magnet 10 facing the interaction space. Preferably, the top end of metal tube 46 is substantially equal in height to the top face of permanent magnet 10 or even closer to vane 12 than the top surface of permanent magnet 10. The inside of envelope 6 is highly evacuated ($10^{-7}$) and, when the magnetron operates, the temperature of the vanes becomes high, approximately 500° C. Accordingly, metal tube 46 is made of material which resists such severe conditions and has a good conductivity, such as copper, copper alloy and molybdenum.

Metal tube 46 partially enclosing output conductor 34 and electrically connected to the anode cylinder 2 serves as an outer conductor for output conductor 34, and thus the combination forms a coaxial line. Microwave radiation generated in the resonant cavities defined by the vanes are introduced by the vane 12 and output conductor 34 connected to it, and then is effectively radiated from output section 44. When permanent magnet 10 is disposed in envelope 6, a space is formed around magnet 10 and output conductor 34 passes through the space. The result is that there is a possibility that the magnetic and electric energies of undesired modes generated in the space will be radiated through output conductor 34 from output section 44. As recalled, however, most of output conductor 34 passing through the space around magnet 10, more exactly approximately 70% or more, is enclosed by metal tube 46, with the result that the undesired electromagnetic waves are shielded, thus preventing such waves from being transmitted through output conductor 34.

Figure 2:
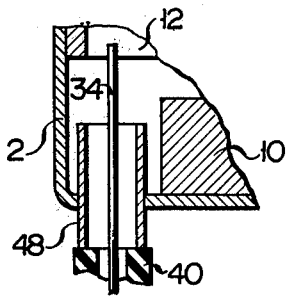
FIGS. 2 and 3 are partial sectional views of the another embodiment of the magnetron of the invention.

Some modifications of the magnetron shown in FIG. 1 will be described with reference to FIGS. 2 to 5. For the purpose of simplicity, same reference numerals are used to designate the same parts or portions. The example in FIG. 2 is a modification of output section 44 in FIG. 1 in which metal tube 46 and metal antenna tube 38 are separately formed, and these individual ones are secured onto the corresponding surfaces of the bottom of anode cylinder 2. In this example, metal cylinder 48 of output section 44 is integrally formed and fixedly fitted into hole 36 formed at the bottom of anode cylinder 2. One of the advantages of the examples is the ease of manufacturing.

Figure 3:
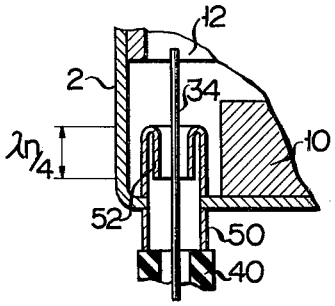

The example in FIG. 3 has a feature that the top end of metal tube 46 is folded inwardly, as shown. The folded portion is denoted as 52. In this example, the height of outer tube 50 is selected to be approximately 70% or more of height of magnet 10 like the previous example and the folded end, or inner tube 52, has a length approximately $\lambda n/4$ of the harmonic wave length $\lambda n$ to be prevented from being transmitted. Thus the selected length of inner tube 52 restricts radiation of the harmonic wave $\lambda n$. If the height of metal tube 46 is $\lambda n/4$ and more than 70% of the thickness of magnet 10 in the FIG. 1 example, the same effect may be expected, and that configuration is preferable. This is because such a configuration can restrict the radiation of harmonic wave without especially folding the top end cylinder 46, like the FIG. 3 embodiment.

Figure 4:
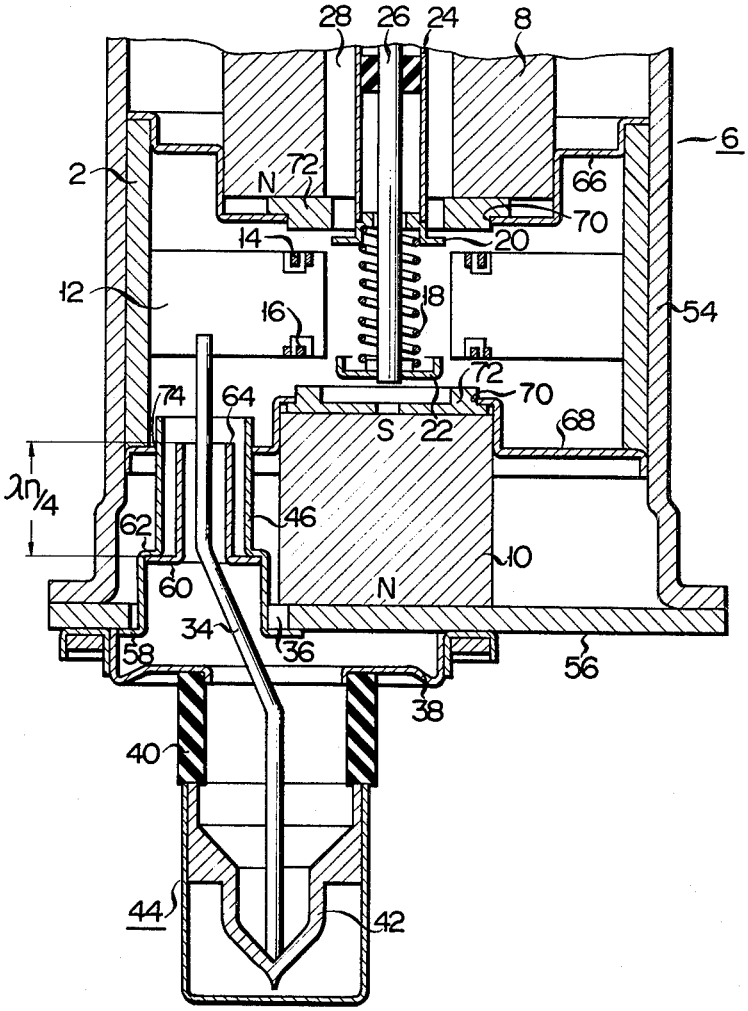
FIGS. 4 and 5 show longitudinal sectional views of still another embodiment of the magnetron of the invention.

Referring now to FIG. 4, there is shown another embodiment of the magnetron according to the invention. As shown, an anode cylinder 2 is fitted in an outer cylinder 54 made of ferromagnetic material. Both open ends of outer tube 54 are closed by means of covers 56 made of ferromagnetic material. In the drawing, only bottom end cover 56 is illustrated for simplicity of illustration. Permanent magnets 8 and 10 are fixed to the corresponding end covers 56, and disposed in the envelope 6 comprised of outer cylinder 54 and end covers 56. In this example, outer cylinder 54 serves as a part of the magnetic path of permanent magnets 8 and 10. Accordingly, anode cylinder 2 may be made of material other than ferromagnetic material. Bottom end cover 56 has hole 36 like the FIG. 1 example into which metal outer tube 46 is inserted and fixed at flange 58 on cover 56, as shown. Inner tube 64 of metal is disposed in metal outer tube 46 in such a manner that flange portion 60 of inner tube 64 is fixed to stepped portion 62 of metal cylinder 46. The length of inner tube 64 is $\lambda n/4$ so as to prevent the harmonic wave $\lambda n$ from being transmitted through output conductor 34 passing therethrough, as in the previous case. Plates 66 and 68 are disposed above and under vanes 12 so in order that electromagnetic fields of undesired modes in the spaces around permanent magnets 8 and 10 do not influence adversely the resonant cavities defined by vanes 12. Each plate 66 and 68 has a hole 70. The peripheral fringe of plate 66 is supported by the top end of the anode cylinder 2. The bottom end of pole piece 72, attached to the bottom face of magnet 8 projects slightly through hole 70 into the space in the anode cylinder 2. The fringe of hole 70 is secured onto the stepped portion of pole piece 72. The same thing is true in the arrangement of plate 68 and pole piece 72 attached onto the top surface of magnet 10. Further, plate 68 has hole 74 through which metal cylinder 46 passes tightly, being coupled with plate 68.

Figure 5:
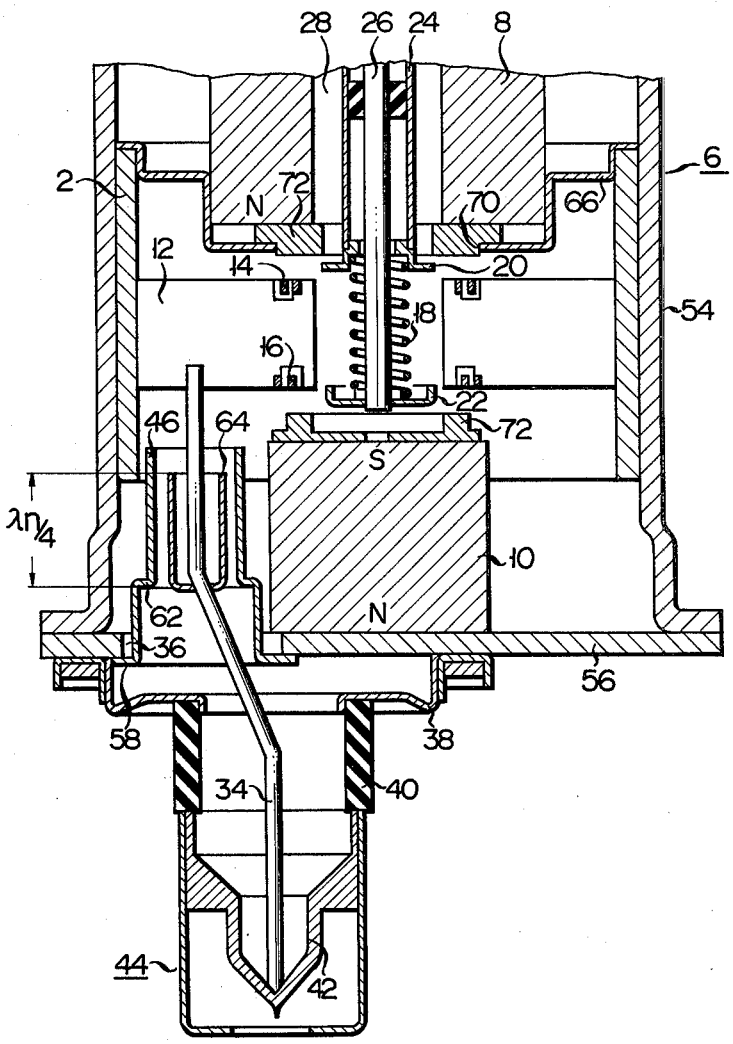

Inner tube 64 may be connected to the outer tube 46, as shown in FIG. 4, but inner tube 64 may alternately be connected to the output conductor 34, being isolated from outer tube 46, as shown in FIG. 5. Also in the example of FIG. 5, if the length of inner tube 64 is selected $\lambda n/4$, it is possible to prevent the adverse influence of electromagnetic radiation of undesired modes on output conductor 34. In the FIG. 5 example, only one shielding plate 66 is used but it is effective in preventing the influence of electromagnetic radiation of undesired modes generated in the space around magnet 8.

Many useful advantages may be attained by the magnetrons in FIGS. 4 and 5. One of them is to effectively transmit the microwave radiation with a desired wave length from the resonant cavities to output section 34. Another is to prevent electromagnetic radiation of undesired modes developed in the peripheral spaces of magnets 8 and 10 from being transmitted through output conductor 34, and further to prevent the resonant cavities from being adversely influenced by the electromagnetic field of unnecessary mode.

As described above, the invention may provide a compact internal magnet type magnetron with a good performance.

What is claimed is:

1. A magnetron comprising:

anode means including an anode cylinder and vanes projecting from the inner wall of the anode cylinder toward the axis of the anode cylinder, defining resonance cavities;

a cathode disposed coaxially with the axis of the anode cylinder;

first and second permanent magnets which are oppositely disposed, generating a magnetic field in a first space between said anode means and cathode, said first magnet having a thickness defined by the distance from the bottom of said anode cylinder to the surface of said first magnet facing said first space;

sealing means for hermetically sealing said permanent magnets, said anode means, said cathode and said first space;

a microwave output section mounted on said sealing means;

an output conductor, connected to one of said vanes and said output section, passing through a second space between said first magnet and said sealing means; and a metal tube through which said output conductor extends, said tube being connected electrically to said anode cylinder and extending into said second space a distance equal to approximately 70% or more of said first magnet thickness.

2. A magnetron according to claim 1, wherein said metal tube is comprised of an inner and an outer tube and the length of the inner tube is approximately ¼ of harmonic wave.

3. A magnetron according to claim 2, wherein the inner cylinder is electrically connected to the outer tube.

4. A magnetron according to claim 2, wherein the inner tube is electrically isolated from the outer tube and is connected electrically to said output conductor.

5. A magnetron according to claim 1, wherein said anode cylinder is made of ferromagnetic material, said sealing means is a covering member made of ferromagnetic material for closing the open ends of said anode cylinder, and said magnets are disposed within the anode cylinder.

6. A magnetron according to claim 1, wherein said sealing means is comprised of an outer cylinder made of ferromagnetic material and a cover for closing the outer cylinder, and said anode cylinder is secured within said outer cylinder.

7. A magnetron according to claim 1, further comprising a pair of shield plates each partitioning said first space between the anode and cathode from said second space between said permanent magnet and said sealing means, the surfaces of said magnets facing said first space protruding through said shield plates, said metal tube passing through one of said shield plates, the open end of said metal tube being disposed in said first space.

* * * * *